US006912733B2

(12) United States Patent
Carrafield et al.

(10) Patent No.: US 6,912,733 B2
(45) Date of Patent: Jul. 5, 2005

(54) HELIX SHIELD AND METHOD OF USING

(76) Inventors: Joannie F. Carrafield, 1640 Avenida Andante, Oceanside, CA (US) 92056; Jaqueline A. Clayton, 1640 Avenida Andante, Oceanside, CA (US) 92056

( * ) Notice: Subject to any disclaimer, the term of this patent is extended or adjusted under 35 U.S.C. 154(b) by 0 days.

(21) Appl. No.: 10/447,486

(22) Filed: May 28, 2003

(65) Prior Publication Data

US 2004/0237175 A1 Dec. 2, 2004

(51) Int. Cl.[7] ..... A42B 1/06
(52) U.S. Cl. ..... 2/209
(58) Field of Search ..... 2/174, 209, 423, 2/455; 128/864, 866; 602/41, 53, 54, 57, 60, 61, 74; 604/304, 307, 308

(56) References Cited

U.S. PATENT DOCUMENTS 2,086,346 A * 7/1937 Zaretsky ..... 2/174
2,261,739 A * 11/1941 Leaf ..... 2/174
2,396,113 A * 3/1946 Motley ..... 2/174
2,468,721 A * 4/1949 Volkmann ..... 181/129
2,570,675 A * 10/1951 Morris ..... 128/866
2,763,869 A * 9/1956 Bogart et al. ..... 2/174
3,452,365 A * 7/1969 Wallace ..... 2/209
3,525,103 A * 8/1970 Yonan ..... 2/174
3,823,713 A * 7/1974 Shah ..... 602/74
3,875,592 A * 4/1975 Aileo ..... 2/209
4,134,153 A * 1/1979 Voorhees ..... 2/174
4,308,623 A * 1/1982 Voorhees ..... 2/174
4,616,643 A * 10/1986 Jung ..... 128/866
4,660,229 A * 4/1987 Harris ..... 2/209
4,713,843 A * 12/1987 Duncan ..... 2/209
4,802,245 A * 2/1989 Miano ..... 2/209
4,872,219 A * 10/1989 Duncan ..... 2/209
4,916,758 A * 4/1990 Jordan-Ross ..... 2/174
5,356,372 A * 10/1994 Donovan et al. ..... 604/304
5,395,675 A * 3/1995 Altholz et al. ..... 604/307
5,615,417 A * 4/1997 Jackson ..... 2/209
5,689,831 A * 11/1997 Harris ..... 2/209
D388,552 S * 12/1997 Weaver ..... D29/112
5,711,026 A * 1/1998 Kaltman et al. ..... 2/9
5,749,099 A * 5/1998 Voorhees ..... 2/209
D399,607 S * 10/1998 Davis ..... D29/112
5,887,590 A * 3/1999 Price ..... 128/858
5,976,117 A * 11/1999 Dunshee et al. ..... 604/307
6,041,440 A * 3/2000 Jackson ..... 2/209
6,069,293 A * 5/2000 De Somma ..... 602/48
6,320,094 B1 * 11/2001 Arnold et al. ..... 602/54

* cited by examiner

*Primary Examiner*—Gary L. Welch
(74) *Attorney, Agent, or Firm*—Gordon & Rees LLP; Hani Z. Sayed

(57) ABSTRACT

A disposable shield for use on the upper portion of the external human ear, including the helix, antihelix, and portions of the tragus and antitragus, comprising a sheet of non-foramenis, foldable paper having a narrow strip of adhesive located adjacent the border, and foldable about the periphery of the ear to affix a portion of the sheet about the rear of the surface of the ear, the front of the surface of the ear, and the peripheral area of the ear between the rear of the surface of the ear and the front of the surface of the ear.

13 Claims, 4 Drawing Sheets

HELIX SHIELD AND METHOD OF USING

BACKGROUND OF THE INVENTION

1. Field of the Invention

This invention pertains to the hairdressing industry. More particularly, it pertains to a device for covering the helix portion of the pinna in order to prevent burning of the skin or tissue of the ear during those processes where the hair is treated with chemicals and then subjected to a flow of hot air, in order to activate the chemicals and establish a hair fashion.

2. Description of the Prior Art

A significant part of a woman's self-esteem involves her hair and how it is arranged. Such emphasis is placed on a woman's well-groomed hair that she will spend significant time and money insuring that it emphasizes her beauty. Not only is there a lot of time spent by ladies is combing their hair and arranging their curls and waves just so, but the hair dressing industry has grown to immense proportion and uses large quantities of shampoos, rinses, colorants, and other complex chemicals to bring out the best highlights of a woman's hair.

Part of these processes involve the application of heat or flow of hot air that are directed down over the woman's head to either dry the hair or cause chemicals placed on the hair to set the hair into a semipermanent style otherwise know as "permanents". Much use is made of the "hair dryer" which is a hood placed over the top and down the sides of the woman's head where warm or hot air is made to flow, for periods of one-half hour or more, over the hair and down around the sides of the woman's face to exit near her chin. During this process, the hair is raised to a rather high temperature to cause the permanent chemicals to set the hair in the desired style.

In this process the woman's external ears are often subject to large amounts of heat energy. The external part of the ear that receives the most heat is usually the prominant rim or helix of the auricle or pinna. This area, along with the other curved prominence, parallel with and in front of the helix, called the antihelix, and the fossa of the helix, located therebetween, may sustain temporary or permanent injury from the heat of the hair dryer. In general, this portion of the ear anatomy is thin, has very little blood flow through it, and thus is not able to be internally cooled except by removing or shielding the heat from the air passing over the ear.

Some efforts to provide shields for the helix have been made in the prior art, however, none of them have met with any degree of commercial success. The primary reason for the failure of most of the patented inventions is that health regulations restrict the use of ear protectors to a single individual so that they must be disposed of after each use. This requires them to be very inexpensive while they must perform the shielding as if they were made of very expensive materials. In addition, the human ear is designed with the external pinna or auricle extending in a non-symmetrical manner from the head in order to collect the vibration of the air by which sound is produced, The nature of the external ear is that it is most economical in design to conduct those vibrations to the pympanum, however, the shape does not allow for easy covering.

For instance, U.S. Pat. No. 2,396,113 requires the manufacture of a component having a significant bulge in it, in order to fit about the bulge created by the posterior portion of the helix at the connection of the ear and the head. Such a bulged component is expensive to make and renders the device too expensive for a single use. U.S. Pat. No. 2,468,721 requires a large, thick sealing ring for placement about the helix and lobe of the ear which makes the device too expensive for a one-of-a-kind use. U.S. Pat. No. 3,452,365 involves the manufacture of a heat insulative, hollow, vertically elongated envelope or shield that is quite expensive and not suited for throw-away use. U.S. Pat. No. 3,875,592 also requires the manufacture of an earcup with many complex parts that disqualifies it for wide-spread, single usage. U.S. Pat. No. 4,134,153 is directed at a throw-away ear protector yet requires a second mask member that raises the manufacture cost beyond the reach of many hair stylists. U.S. Pat. No. 4,616,643 involves an ear protector made of rubber or thermoplastic material, three-dimensional in character, for use about the ear. Manufacturing costs involving any three-dimensional products eliminates them from consideration as a throw-away device. U.S. Pat. No. 4,660,229 involves the use of a first strip of polyethylene film, a second strip of inelastic material, and a rubber band, which, purely by their numerosity, results in a high manufacturing cost. U.S. Pat. No. 4,872,219 involves an ear protector requiring a core member, an outer protective layer, and an inner layer. In the process of making the device one must use vacuum forming machines and a sewing machine. All of these processes make the device too expensive to use on a single customer. U.S. Pat. No. 4,916,758 involves an ear-covering web, an ear plug, a rope, and a sewn-on border that makes the device too expensive for consideration as a throw-away ear protector. Finally, U.S. Pat. No. 6,041,440 discloses an ear protector comprising a lower support member, an upper support member, a recessed member, a diagonally descending back member, first, second, and third elongated members, and more which makes this device unacceptable as a cheap, throw-away ear protector. Unfortunately, none of these devices has ever reached market usage which leaves the majority of women in the world still suffering from burnt ears in order to obtain their desired hair style.

SUMMARY OF THE INVENTION

This invention is an ear protector used in the hair-drying process that provides significant protection against injury caused by overheating the parts of the ear, and yet is so very inexpensive that it can be made for a fraction of a penny and thus thrown away after a single use without causing any financial loss to the hair stylist.

The invention is a disposable paper shield for placement on the upper portion of the external human ear, including the helix, antihelix, and portions of the tragus and antitragus, that comprises a sheet of non-foramenis, foldable paper having a narrow strip of adhesive, located adjacent the border on one side thereof, and foldable about the periphery of the ear to fix a portion of the sheet about the rear of the surface of the ear, the front of the surface of the ear, and peripheral area of the ear between the rear of the surface of the ear and the front of the surface of the ear.

In addition, the invention includes a method of applying the disposable shield including the steps of placing the sheet of paper behind the ear, between the extrinsic surface of the pinna and the neighboring side of the head, arranging the sheet so that the adhesive is facing outward from the head, folding the top portion of the sheet outward over the ear, about the periphery of the ear and downward over the external surface of the ear, folding the side portions of the sheet toward the middle of the ear and pinching the edges of the sheet to cause the adhesive to stick to portions of the sheet and to hold the folded portion of the sheet in place over the ear.

Accordingly, the main object of this invention is a small, flat paper having a border of adhesive for placement about the rear of the ear and folded forward, over the top and sides of the ear, and held there with the adhesive during the hair drying cycle. Other objects of the invention include a means to protect the ear from injury by overheating during certain hair processes using an inexpensive device that can be discarded when the customer emerges from the hair styling process; a means to provide protection to the ear at a small expense, using inexpensive materials that are free of the surface forming problems of the prior art, and a device that has a surface amenable to printing to allow a hair dresser to advertise his or her services on one of the very products he or she used around the customer.

These and other objects of the invention will become more clear when one reads the following specification, taken together with the drawings that are attached hereto. The scope of protection sought by the inventors may be gleaned from a fair reading of the claims that conclude this specification.

DESCRIPTION OF THE PREFERRED EMBODIMENT

Figure 1:
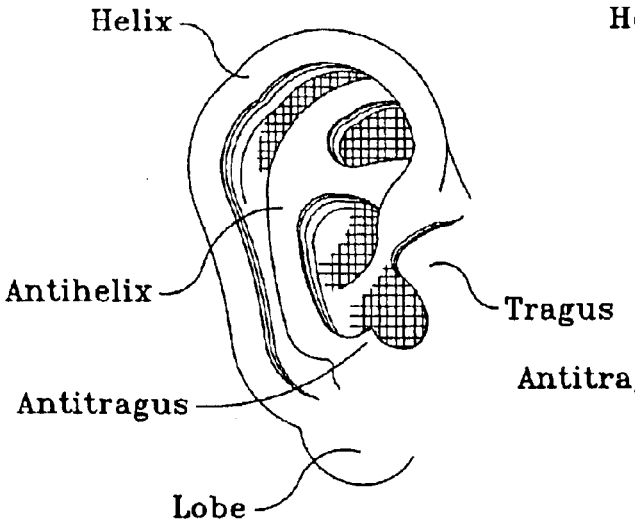
FIG. 1 is a side view of the external components of the human ear.
Figure 2:
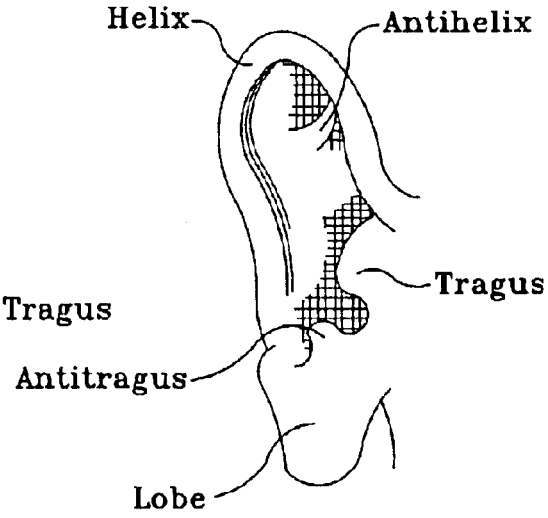
FIG. 2 is a front view of the human ear shown in FIG. 1.
Figure 3:
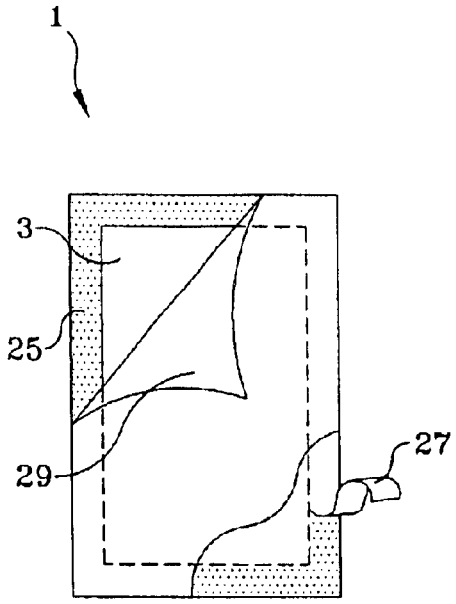
FIG. 3 is a top plan view of the preferred embodiment of the protective ear sheet of this invention.

Turning now to the drawings, wherein elements are identified by numbers and like elements are identified by like numbers throughout the eleven figures, FIGS. 1 and 2 show side and front views, respectively, of the anatomy of the external human ear and show the various components such as the helix, the antihelix, the tragus, the antitragus, and the ear lobe. FIG. 3 depicts the preferred embodiment of this invention and shows a disposable shield 1 for use with the upper portion of the external human ear, including the helix, antihelix, and portions of the tragus and antitragus. In its preferred embodiment, shield 1 comprises a sheet 3 of non-foramenis, foldable paper, preferrably rectangular with its top edge 5 and bottom edge 7 set wider than its left side edge 9 and its right side edge 13, thereby forming corners 15, 17, 19 and 21. A preferred size is 3 inches wide and 2 inches tall. It is preferred that side edges 9 and 13 extend beyond the tragus and the helix of the ear or, in other words, be made wider than the ear, so that the excess paper on the sides of the ear may be folded over the ear and against the front part of the sheet that is folded downward over the front of the ear.

As shown in FIG. 3, a narrow strip 25 of adhesive is placed about the periphery of sheet 3 and preferably adjacent edges 5, 7, 9 and 13. Strip 25 may be placed on both sides of sheet 3, however, it is preferred that the adhesive be placed on only one side. The adhesive making up strip 25 is preferably of the type that is always sticky to touch and does not require moistening before use. Examples of such adhesives are readily found in the paper industry and are commonly used on the rear surface of stamps and on envelope flaps. A cover paper is provided to cover adhesive strip 25, either in the form of a plurality of narrow strips 27 or one strip set about all four sides of sheet 3, or as a single, full-sized sheet of paper 29 set over the entire surface, including strip 25, of the "sticky" side of sheet 3. The cover paper should be treated with a substance, such as silicon, that clings sufficiently enough to the adhesive to provide protection but not strongly enough to prevent its being pulled off of the adhesive and allowing the tack in the adhesive to remain viable.

An example of a non-formaenis (i.e., without holes) foldable paper useful in this invention is a long grain, white, predominantly rag paper, having a Brightness of 92, and a weight of about 20 pounds American avoirdupois, per ream, and that is foldable. Such a paper is available from United Stationers Supply Co., Des Plaines, Ill. 60016, USA.

Figure 4:
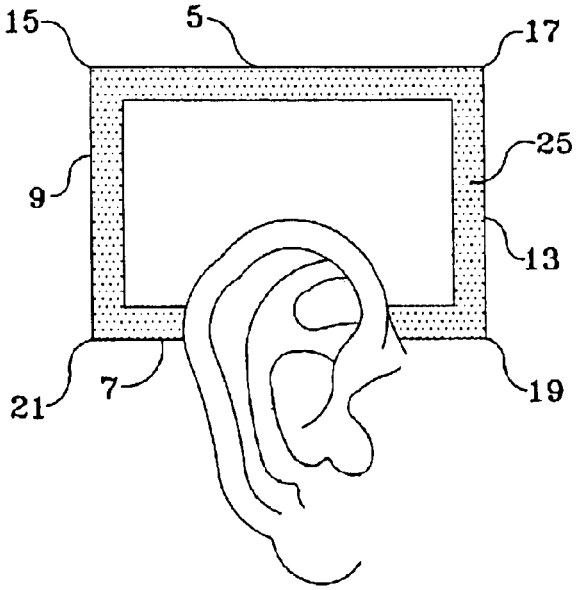
FIG. 4 is an illustrative view of the protective ear sheet of this invention arranged behind the ear prior to the sheet being folded into operative configuration.
Figure 5:
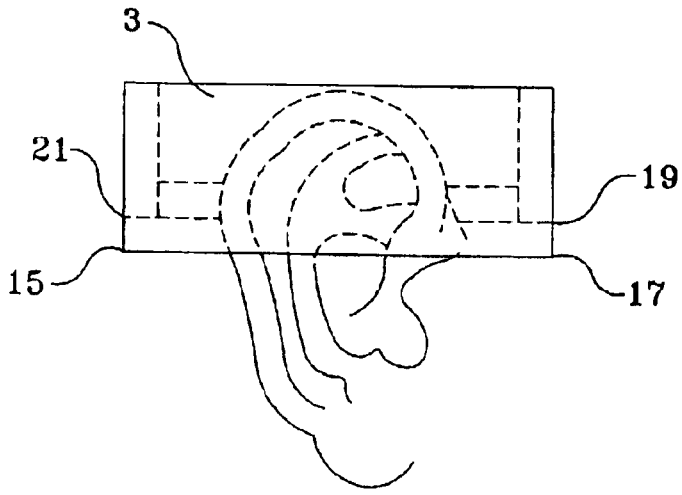
FIG. 5 is an illustrative view of the protective ear sheet shown in FIG. 4 after part of the sheet is folded forward over the ear.
Figure 6:
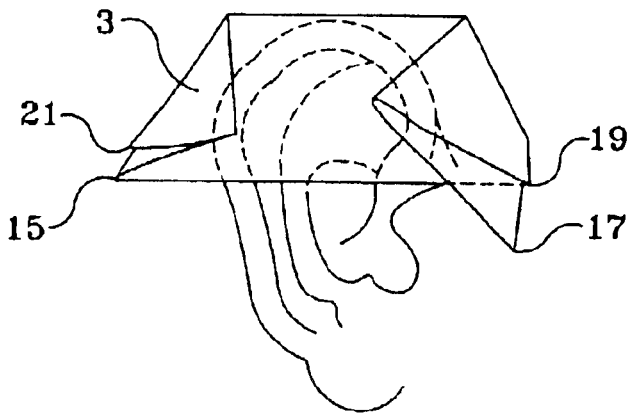
FIG. 6 is the same illustrative view of the sheet shown in FIG. 5 after the lateral ends have been folded forward toward the center of the ear.

As shown in FIG. 4, the use of sheet 3 begins with it being placed behind the ear, above the juncture with the head, with adhesive strip 25 facing outward. It may be placed in position horizontal, as shown in FIG. 4, and the upper horizontal portion merely folded outward, over and down along the front of the ear as shown in FIG. 5. FIG. 6 shows the same orientation of sheet 3, however, the lateral forward and rearward ends have been folded down about the ear. In each use of sheet 3, after folding to the desired configuration, the edges are pinched together to allow the adhesive to hold the edges together.

Figure 7:
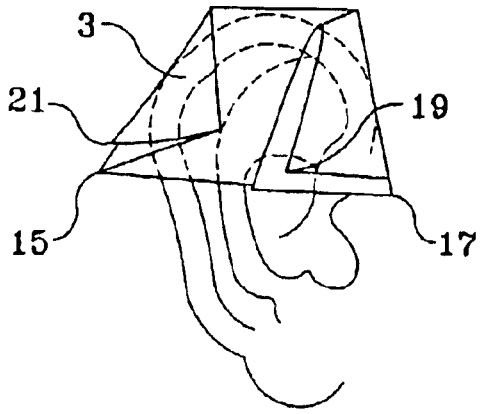
FIG. 7 is an illustrative view of the sheet shown to be rotated slightly toward the front of the ear and folded over the ear to protect it.
Figure 8:
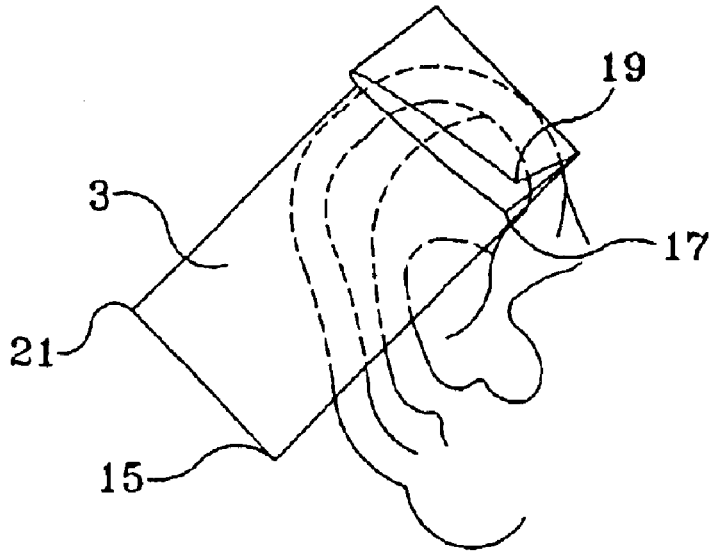
FIG. 8 is an illustrative view of the sheet shown to be rotated slightly toward the rear of the ear and folded at the front end, over the ear, to protect it.
Figure 9:
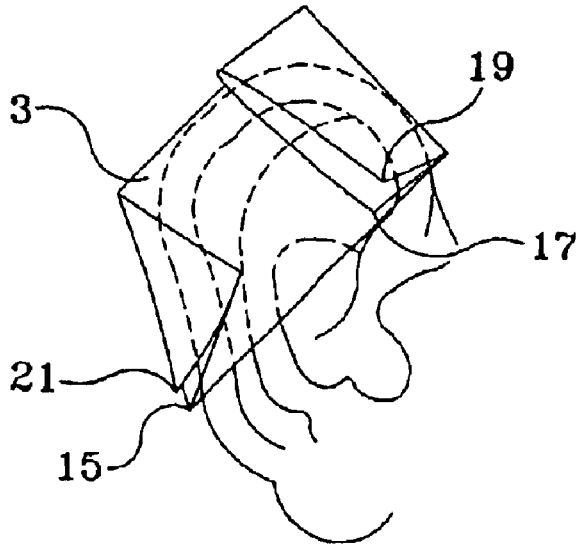
FIG. 9 is the same illustrative view of the sheet shown in FIG. 8 and folded at the rear over the ear to protect it.

Sheet 3 may also be tilted forward, toward the front of the ear, and the ends of the sheet folded, as shown in FIG. 7, or tilted rearward, toward the base of the ear, as shown in FIG. 8. Also, one may have the forward end folded downward over the ear or, as shown in FIG. 9, have both the forward end and the rearward end folded downward over the ear. The desired folding arrangement depends upon the desires of the customer, or the location of placement of the chemicals, or a combination of both.

Figure 10:
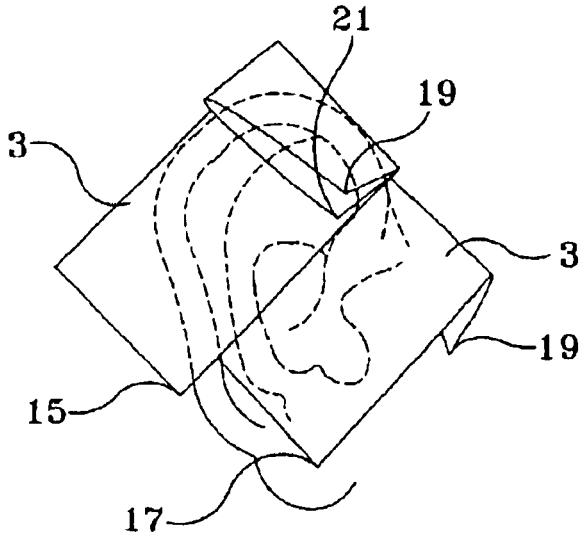
FIG. 10 is an illustrative view of two sheets arranged over the front and over the rear of the ear and folded at the front end, over the ear, to protect it; and, FIG. 11 is a perspective view of a stack of protective ear sheets showing the full size cover paper to be partially peeled off of the stack.

FIG. 10 shows the use of two of sheets 3, one sheet 3 tilted forward of the ear with the front of it folded downward, over the ear, and the top corner folded behind the ear, and the other sheet 3, placed behind the ear and the first sheet 3, tilted rearward of the ear, the front of it folded downward over the ear and the top corner also folded downward over the ear. The two sheet arrangement, shown in FIG. 10, provides more coverage over the ear than a single sheet of paper.

When adhesive strip 25 is placed on both sides of sheet 3, it is better to use two, individual full size cover papers 29 to keep the adhesive clear. With this configuration, that part of strip 25 facing rearward of the ear, or toward the head, can be pressed against the head to hold the paper or papers even tighter to the ear and provide more protection for the ear, unless so doing will mar the arrangement of the hair in the hair style.

Figure 11:
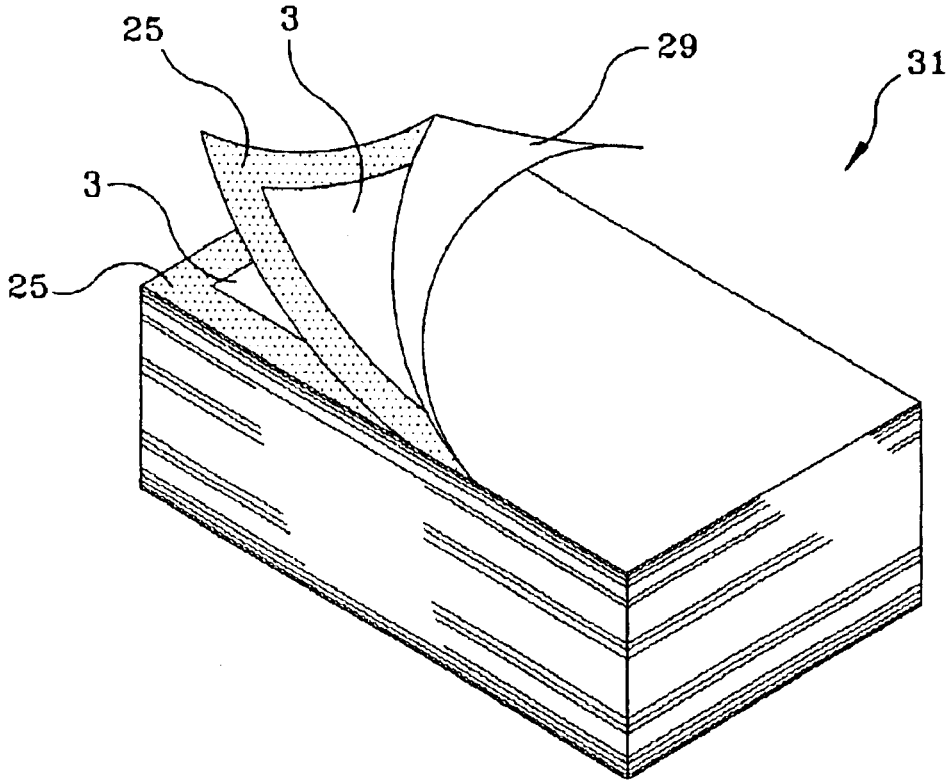

Sheets 3 may be placed in a stack 31, as shown in FIG. 11, and covered with a single cover paper 29. In this situation, if adhesive strip 25 is placed on only one side of sheet 3, then each sheet 3 may act as the cover sheet for the sheet below it. If adhesive strip 25 is placed on both sides of sheet 3, then an extra cover paper 29 must be interposed between sheets 3 in stack 31.

The method of using the disposable shield of this invention to protect the upper portion of the external human ear, including the helix, antihelix, and portions of the tragus and antitragus, is by first, insuring that sheet 3 comprises a non-foramenis, foldable paper having strips 25 of adhesive located adjacent the border of the sheet. The following steps are then undertaken: Sheet 3 is placed behind the ear, between the extrinsic surface of the pinna and the neighboring side of the head. Sheet 3 is arranged so that adhesive strip 25 faces outward from the head. If there are adhesive strips on both sides of the sheet, then this arrangement cannot be achieved. The top portion of sheet 3 is then folded outward from the head, over the ear, about the periphery of the ear, and downward over the external surface of the ear. Optionally, the side portions of sheet 3 may then be folded toward the middle of the ear. The edges of sheet 3 are then pinched together to cause adhesive strips 25 to stick to portions of either sheet 3 or to other areas of strips 25 to hold sheet 3 in place over the ear. When the heat cycle or drying process is completed, sheet 3 is merely removed and discarded. When sheet 3 is covered by strips 27 or paper 29, they should be removed before beginning the above process.

Both sheet 3 and cover paper 29 are capable of accepting printing thereon so that they can be decorated or made to carry the trademark or service mark or "logo" of the institution doing the hair styling.

While the invention has been described with reference to a particular embodiment, those skilled in the art will be able to make various modifications to the described embodiment of the invention without departing from the true spirit and scope thereof. It is intended that all combinations of elements and steps which perform substantially the same function in substantially the same way to achieve substantially the same result are within the scope of this invention.

What is claimed is:

1. A disposable shield for use on the upper portion of the external human ear to protect the ear from heat exposure, the shield used on the external ear including the helix, antihelix, and portions of the tragus and antitragus, comprising a sheet of non-foramenis paper having a narrow strip of adhesive located adjacent the border, and foldable about the periphery of the ear to fix a portion of said sheet about the rear of the surface of the ear, the front of the surface of the ear, and peripheral area of the ear between the rear of the surface of the ear and the front of the surface of the ear and further wherein the shield is foldable about the peripheral area of the ear and the fold extends outward from the periphery of the helix of the ear to the space behind the helix of the ear wherein said sheet is rectangular in shape and of a width sufficient to extend beyond the side borders of the ear when placed behind the ear and further wherein said sheet may be folded behind the periphery of the ear and folded onto itself to attach to itself to secure reduced exposure to heat by the ear.

2. The disposable shield of claim 1 wherein said adhesive is placed on only one side of said sheet.

3. The disposable shield of claim 1 wherein said sheet is rectangular in shape.

4. The disposable shield of claim 1 wherein said sheet is rectangular in shape and of a width sufficient to extend beyond the side borders of the ear when placed behind the ear.

5. The disposable shield of claim 1 wherein said narrow strip of adhesive is located about the entire border of only one side of said sheet.

6. The disposable shield of claim 1 further including a removable cover layer for temporary placement over said strips of adhesive.

7. The disposable shield of claim 1 further including a removable cover layer for temporary placement over the entire surface of one side of said sheet including said strips of adhesive.

8. A method of using a disposable shield for the upper portion of the external human ear, including the helix, antihelix, and portions of the tragus and antitragus, wherein said heat protecting sheet comprises a sheet of non-foramenis, paper having adhesive located adjacent the border of said sheet, comprising the steps of:

a) placing said heat protecting sheet of paper behind the ear, between the extrinsic surface of the pinna and the neighboring side of the head;

b) arranging said heat protecting sheet so that said adhesive is facing outward from the head;

c) folding the top portion of said heat protecting sheet outward over the ear, about the periphery of the ear and downward over the external surface of the ear;

d) folding the side portions of said heat protecting sheet toward the middle of the ear wherein when folded the sheet extends over said external surface of the ear and beyond the periphery of said ear; and, e) pinching the edges of said heat protecting sheet to cause said adhesive to stick to portions of said sheet to hold the folded portion of said sheet in place over the ear wherein said edges of said sheet extend beyond the periphery of the ear.

9. The method of using a disposable shield of claim 8 wherein said sheet is protected by a cover layer, covering said adhesive, and including the additional, initial step of removing said cover layer from over said strip of adhesive.

10. The method of using a disposable shield of claim 8 wherein said sheet is rectangular and of sufficient width to extend beyond the side borders of the ear when placed behind the ear.

11. The method of using a disposable shield of claim 10 including the additional step of placing said sheet behind the ear so that part of said sheet extends beyond both sides of the ear.

12. The method of using a disposable shield of claim 8 including the additional step of placing said narrow strip of adhesive on only one side of said sheet and arranging said sheet behind the ear so that said adhesive faces outward.

13. The method of using a disposable shield of claim 8 wherein the steps of folding the top of said sheet first and folding the sides of said sheet later are interchanged.

* * * * *